US010715932B2

(12) United States Patent
Liebich et al.

(10) Patent No.: US 10,715,932 B2
(45) Date of Patent: Jul. 14, 2020

(54) ACTIVE SUPPRESSION OF OCCLUSION EFFECT IN HEARING AID

(71) Applicant: Rheinisch-Westfaelische-Technische Hochschule Aachen, Aachen (DE)

(72) Inventors: Stefan Liebich, Aachen (DE); Carlotta Anemueller, Lemiers (NL); Daniel Rueschen, Aachen (DE)

(73) Assignee: RHEINISCH-WESTFAELISCHE TECHNISCHE HOCHSCHULE AACHEN, Aachen (DE)

( * ) Notice: Subject to any disclaimer, the term of this patent is extended or adjusted under 35 U.S.C. 154(b) by 0 days.

(21) Appl. No.: 16/330,887

(22) PCT Filed: Sep. 28, 2017

(86) PCT No.: PCT/EP2017/001154

§ 371 (c)(1),
(2) Date: Mar. 20, 2019

(87) PCT Pub. No.: WO2018/059736

PCT Pub. Date: Apr. 5, 2018

(65) Prior Publication Data

US 2019/0215622 A1 Jul. 11, 2019

(30) Foreign Application Priority Data

Sep. 30, 2016 (DE) ..... 10 2016 011 719

(51) Int. Cl.
*H04R 25/00* (2006.01)

(52) U.S. Cl.
CPC ..... *H04R 25/505* (2013.01); *H04R 25/30* (2013.01); *H04R 25/50* (2013.01); *H04R 25/70* (2013.01); *H04R 2460/05* (2013.01)

(58) Field of Classification Search
CPC . H04R 25/00; H04R 2225/49; H04R 2460/01
(Continued)

(56) References Cited

U.S. PATENT DOCUMENTS 8,069,022 B2 * 11/2011 Slabaugh ..... G06K 9/6206 381/312

8,116,489 B2 2/2012 Mejia
(Continued)

OTHER PUBLICATIONS

U.S. Appl. No. 97/299,770, filed Aug. 2017, A. Niederberger.

*Primary Examiner* — Suhan Ni
(74) *Attorney, Agent, or Firm* — Andrew Wilford

(57) ABSTRACT

A hearing aid for compensating for an occlusion effect while emitting an acoustic useful signal into an auditory canal of a human ear comprises an earbud that can be inserted into the auditory canal, a speaker for emitting a compensation signal into the auditory canal, a microphone for receiving an error signal from the auditory canal, and a control unit for processing a recorded signal to be emitted. The controller is designed by measuring a nominal secondary path between a speaker and the microphone and determining a transmission function that describes behavior of the nominal secondary path, determining a first requirement as a tolerance band about the transmission function, determining a second requirement as a desired sensitivity function of the hearing aid, designing the controller using an optimization method while simultaneously taking the first and second requirements into consideration, and implementing the controller in the control unit.

10 Claims, 6 Drawing Sheets

(58) Field of Classification Search
USPC ..... 381/312, 316–317, 320–321
See application file for complete search history.

(56) References Cited

U.S. PATENT DOCUMENTS 8,693,717 B2 * 4/2014 Kasanmascheff ..... H04R 25/50
381/317
9,319,814 B2 4/2016 Zurbruegg

* cited by examiner

ACTIVE SUPPRESSION OF OCCLUSION EFFECT IN HEARING AID

CROSS REFERENCE TO RELATED APPLICATIONS

This application is the US-national stage of PCT application PCT/EP2017/001154 filed 28 Sep. 2017 and claiming the priority of German patent application 102016011719.2 itself filed 30 Sep. 2016.

FIELD OF THE INVENTION

The present invention relates to a method of designing a controller for a hearing aid in order to compensate for the occlusion effect when emitting an acoustic useful signal into the ear canal of a human ear

BACKGROUND OF THE INVENTION

The muffled perception of one's own voice is still a major problem with hearing aids. This effect occurs when the ear canal is completely blocked, which is why it is referred to as the occlusion effect (OE). Such blocking of the ear canal occurs especially with hearing aids, which usually consist of a central unit fitted behind the ear and an associated internal unit in the form of an earbud inserted into the auditory canal and blocking it tightly.

The external unit generally comprises a power source in the form of one or more batteries, one or more external microphones, and a processor for processing and possibly amplifying the signal recorded by the external microphone, and an interface to the internal unit that, in turn, has a speaker to which an output signal processed by the processor is fed, which output signal corresponds at best to the natural external sounds at the ear that are recorded by the external microphone so that the wearer of the hearing aid can perceive these natural external sounds at a pleasant volume, without distortion, and in good quality despite impaired hearing. However, hearing aids are also known in which the external microphone is part of the internal unit or in which the components of the external and internal unit form a single compact internal unit.

Figure 1:
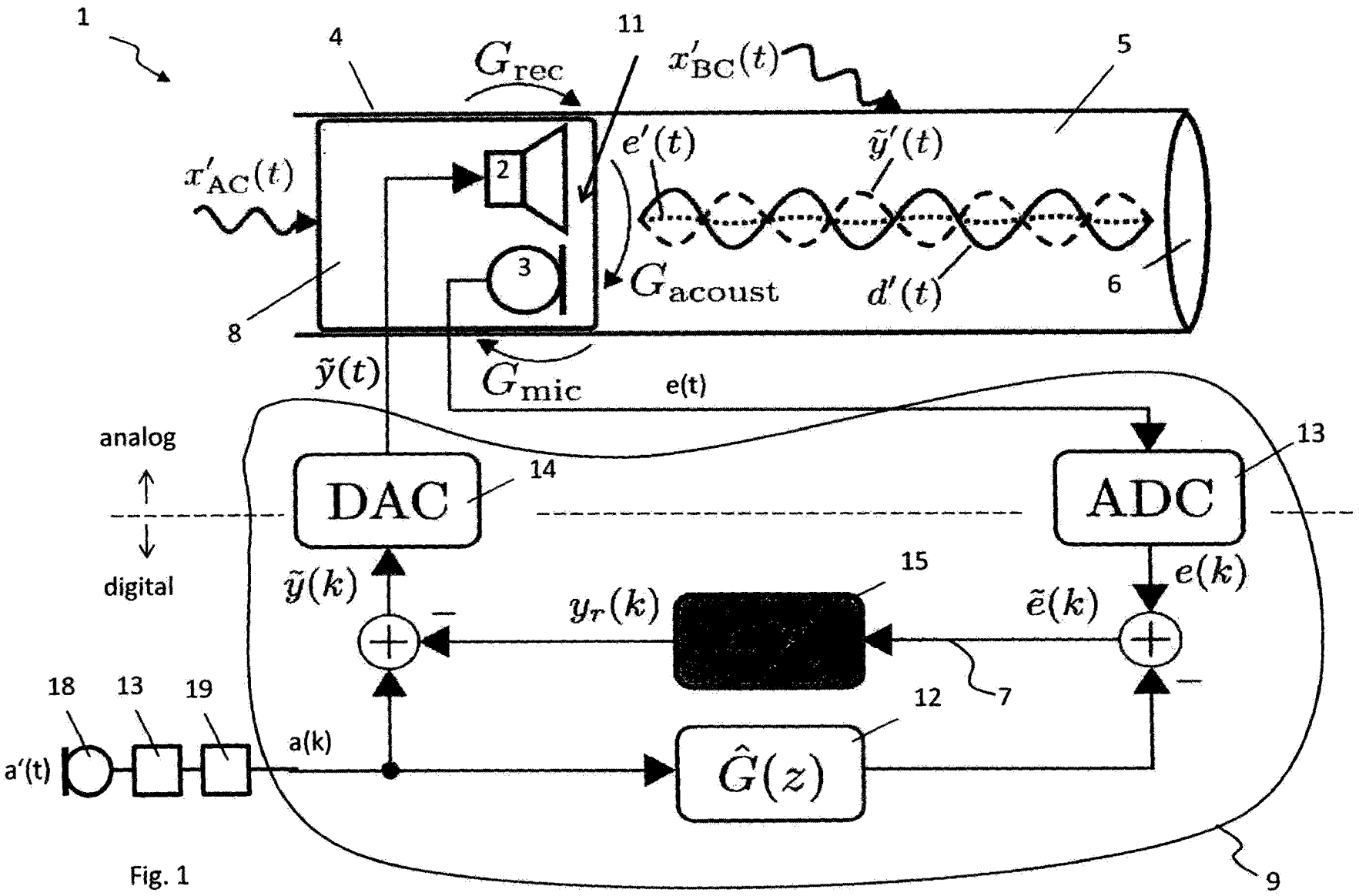
FIG. 1 is a schematic view of a hearing aid according to the invention.

The muffled perception of one's own voice essentially results from two factors. First, the perception of one's own voice is always a combination of two main signals with respect to the human ear itself. The first main signal is characterized by an acoustic wave component, $x'_{AC}(t)$, that is conducted via the air (AC, Air-Conducted), and the second main signal is characterized by an internal component, $x'_{BC}(t)$, that is conducted via the bone and cartilage (BC, Bone-Conducted), as shown in FIG. 1. Thus, one hears one's own voice in the ear from two sources, from the airborne sound $x'_{AC}(t)$ and from the structure-borne sound $x'_{BC}(t)$. This is also the reason why one hears one's own voice differently when speaking than when one hears oneself from a recording. After all, the structure-borne sound component $x'_{BC}(t)$ is missing from the recording. Second, the internal part of a hearing aid, i.e. the earbud, blocks the auditory canal and thus alters its acoustic terminating resistance. The internal part also poses an obstacle to acoustic waves from outside the ear that damps the high frequencies of the airborne sound signal $x'_{AC}(t)$. Moreover, the low-frequency components introduced into the auditory canal by the structure-borne sound signal $x'_{BC}(t)$ cannot escape the auditory canal. This leads to an amplification of the low frequencies by up to 30 dB in extreme cases.

Mechanical solutions for preventing the occlusion effect are known and include the ventilation of the ear canal or a deep insertion of the hearing aid into the ear canal, for example (see Thomas Zurbrugg, "Active Control Mitigating the Ear Canal Occlusion Effect caused by Hearing Aids," Ph.D. dissertation, EPFL Lausanne, Lausanne, 2014). However, these are not without drawbacks. For instance, ventilation through a vent opening in the earbud increases feedback between the outside microphone and the speaker. Furthermore, deep insertion of the earbud into the auditory canal adversely affects wearing comfort.

As an alternative to mechanical compensation for the occlusion effect, approaches have therefore been developed that employ active noise cancellation (ANC) in order to achieve "electronic ventilation." In these approaches, a second microphone is used that is located next to the speaker in the internal unit/earbud and records the acoustic signals in the auditory canal, with the recorded signal being fed back negatively to the signal to be emitted by the speaker, and with a controller arranged in the feedback branch having the task of influencing the signal to be outputted by the speaker such that the occlusion effect is minimized.

Such an approach is described, for example, in the above-described publication by Thomas Zurbrugg, in European patent application EP 2 640 095 [U.S. Pat. No. 9,319,814], and in international patent application WO 2006/037156 [U.S. Pat. No. 8,116,489], as well as in the publications "Active cancellation of occlusion: An electronic vent for hearing aids and hearing protectors," Journal of the Acoustical Society of America, vol. 124, No. 1, pp. 235-240, 2008 and M. Sunohara, M. Osawa, T. Hashiura, and M. Tateno, "Occlusion reduction system for hearing aids with an improved transducer and associated algorithm," in 2015 23rd European Signal Processing Conference (EUSIPCO), 2015, pp. 285-289. However, this prior art uses a fixed, i.e. immutable, controller. The occlusion effect is however different for each person due to the shape and length of their auditory canal and in each application, since a user does not always insert the internal unit the same way into the auditory canal. Thus, both the orientation of the earbud/angle of the speaker and the insertion depth of the internal unit vary with each use. The use of a fixed controller in the individual user therefore does not lead to a good result.

In addition, solutions with adaptive controllers that have to be manually set or parameterized for a specific user are known from the publications "R. Borges, M. Costa, J. Cordioli, and L. Assuiti, "An Adaptive Occlusion Cancers for Hearing Aids," in IEEE Workshop on Signal Processing to Audio and Acoustics, 2013, and M. Sunohara, K. Watanuki, and M. Tateno, "Occlusion reduction system for hearing aids using active noise control technique," Acoustical Science and Technology, Vol. 35, No. 6, pp. 318-320, 2014. It is true that an adaptive controller does lead to an improvement in the suppression of the occlusion effect given the individual adaptation. With respect to the various applications in terms of orientation and insertion depth of the internal unit, the previous approaches do not lead to satisfactory results. In particular, the stability of the overall system with the feedback controller is not considered in the literature but represents one of the main problems of the electronic reduction of the occlusion effect.

OBJECT OF THE INVENTION

It is therefore the object of the invention to provide a controller for a hearing aid that overcomes the drawbacks of the prior art and leads particularly both to an effective user-specific and to a robust user-independent compensation of the occlusion effect.

SUMMARY OF THE INVENTION

According to the invention, a method of designing a controller K for a hearing aid for the purpose of compensating for the occlusion effect in the emission of an acoustic useful signal into the auditory canal of a human ear is proposed in which the hearing aid comprises an earbud that can be inserted into the ear with a speaker for emitting a compensation signal y'(t),y(t) into the auditory canal, and a microphone for receiving an error signal e'(t) from the auditory canal, as well as a control unit for processing the recorded signal to be emitted, the method comprising the following steps:

- measuring a nominal secondary path between the speaker (2) and the microphone (3) and determining a transmission function (G) that describes the behavior of the nominal secondary path,
- determining a first requirement in the form of a tolerance band $W_{tol}$ about the transmission function (G),
- determining a second requirement in the form of a desired sensitivity function ($S_{gew}$) of the hearing aid,
- designing the controller (K) using an optimization method while simultaneously taking the first and second requirement into consideration, and implementing the controller (K) in the control unit.

Figure 3:
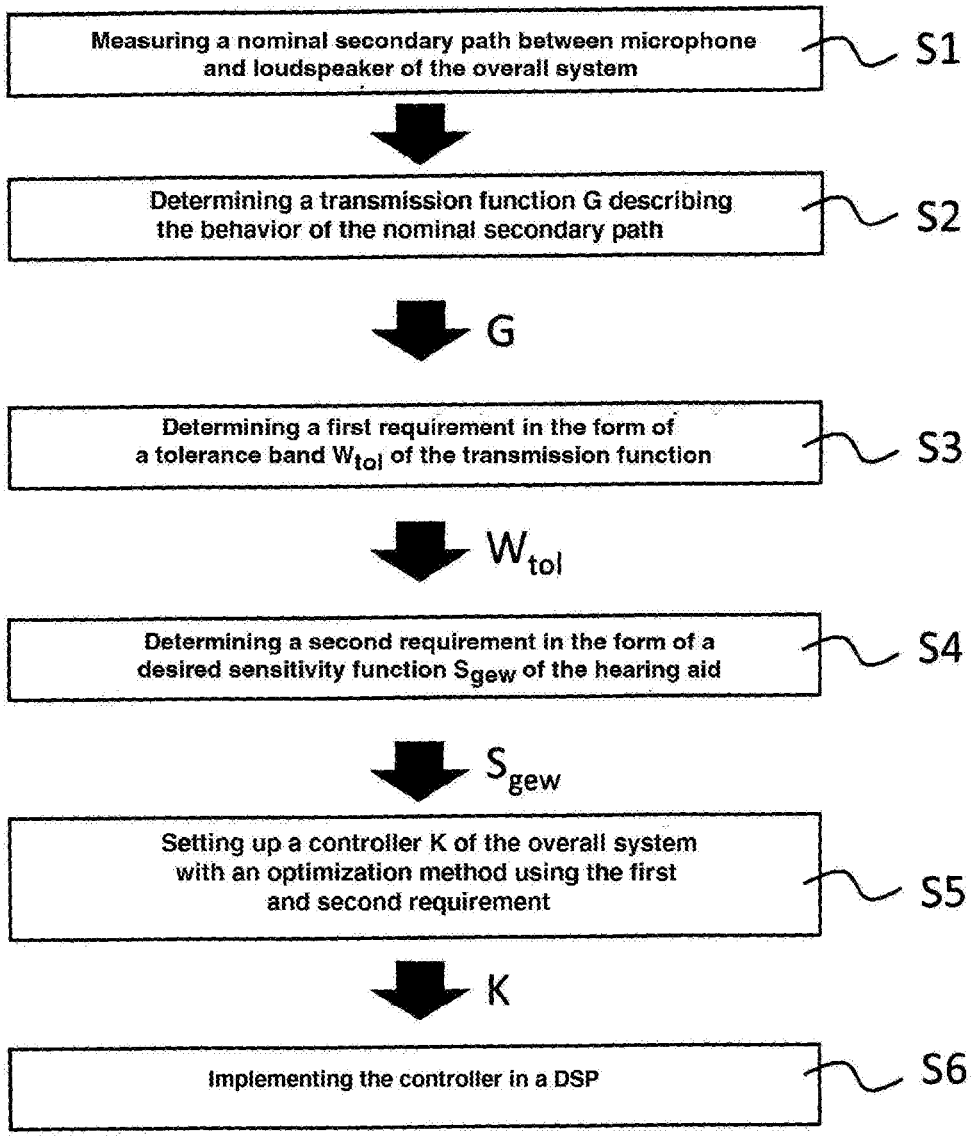
FIG. 3 is a flow chart illustrating the invention.

In the interest of better understanding, the method will be explained in the following with reference to the accompanying figures. FIG. 3 shows a flowchart with the above-described steps. It should be expressly noted, however, that the method is by no means limited to what is shown in the figures. The figures show only examples of possible manifestations of the method and are not to be understood as limiting the invention in this respect.

SPECIFIC DESCRIPTION OF THE INVENTION

FIG. 1 is a schematic view of an embodiment of a hearing aid 1 according to the invention, of which only an earbud 8 and a control unit 9 are shown in detail here. The earbud 8 is introduced into the auditory canal 5 that is also referred to as the ear canal in the context of the invention. Reference numeral 4 indicates the auricle of the human ear. The auditory canal 5 is thus closed off toward the auricle 4 by the earbud 8 and in the other direction by the eardrum 6.

The earbud 8 comprises a speaker 2 and a microphone 3 that are arranged next to one another. The region between the speaker 21 microphone 3 and the housing of the earbud 8 is referred to as a sound channel 11. As explained in the introductory part of the description, one's own voice consists of an air-conducted component $x'_{AC}(t)$ and a bone-conducted component $x'_{BC}(t)$, both of which enter the auditory canal 5 and induce the internal acoustic interference signal d'(t) there.

The control unit 9 of the hearing aid 1 comprises all of the signal processing components required for the inventive compensation of the occlusion effect. In principle, it can be purely analog, purely digital, or constructed from a combination of analog and digital components. In the design variant shown in FIG. 1, the control unit has a digital construction and comprises, in particular, a digital controller 15, an analog-to-digital converter 13, a digital-to-analog converter 14, and a digital secondary path model 12.

The hearing aid 1 further comprises an external microphone 18 for recording voices and sounds from the environment that are described by the acoustic useful signal a'(t). Optionally, an analog-to-digital converter 13 associated with the external microphone as well as a signal processor 19 for the external signal can also be part of the control unit 9. This is not mandatory, however. The control unit 9 itself can be formed by a digital signal processor (DSP) or comprise such a DSP.

The speaker 2 emits an internal acoustic compensation signal '(T) that eliminates the interference signal d'(t) to the greatest possible extent so that only an acoustic error signal e'(t) remains that is picked up by the microphone 3, converted as an analog electrical error signal e(t) by the analog-to-digital converter 13 into the digital error signal e(k), and fed to the controller K(z) 15 that generates a digital controller signal $y_r(k)$ that is fed to the speaker 2 with a negative sign. The controller 15 is thus located on a feedback path 7 from the microphone 3 to the speaker 2.

The electrical signal a(t) generated by the external microphone 18 is likewise digitized by an analog-to-digital converter 13 and subsequently processed, for example amplified and/or filtered, in a signal processor 19. The signal processor 19 can also be upstream from the digitization 13, i.e. take place in the continuous time domain. In the normal case, the digital useful signal a(k) is fed to the speaker 2 of the hearing aid 1, but after having been previously overlaid with the negative controller signal $y_r(k)$. The overlaid digital signal $a(k)-y_r(k)$ is then converted by the digital-to-analog converter 14 into an analog electrical signal, fed to the speaker 2, and outputted accordingly.

Since the useful signal a'(t) has no significance for the design of the controller 15 that serves to compensate for the occlusion effect, it is omitted here for the sake of simplicity or set to zero. Thus, the controller signal $y_r(k)$ corresponds to the digital compensation signal y(k), except for the sign, meaning that the controller 15 directly specifies the compensation signal. The controller 15 then receives only the error signal e(k) as an input signal, because the signal path below the feedback path 7 has no effect.

In reality, however, the useful signal a'(t) is different from zero, so that the speaker 2 outputs not only the inverted controller signal $y_r(k)$ but also, and as intended, the useful signal, as an overlay of the two signals. This means the microphone 3 also receives the useful signal again, but altered by the transmission characteristic of the secondary path, so that not only the previously described error signal e(k) but also a useful signal overlaid with same is fed to the controller 15. To eliminate this, the digital payload signal is fed to a model 12 whose transmission function corresponds to the estimated transmission function G(z) of the actual secondary path, so that the digital output signal of the model 12 corresponds exactly to the digitized signal that the microphone 2 picked up due to the useful signal present in the auditory canal 5. This model output signal is then subtracted from the digital microphone signal, so that only the pure error signal e(k) resulting from the difference of the interference signal d'(t) and the compensation signal y'(t) is now actually fed to the controller 15. However, since the model 12 is based only on an estimate G of the secondary path, the model output and the portion in the microphone signal originating from the useful signal differ from one another, so that the subtraction of the model signal from the microphone signal does not yield precisely the error signal, but rather a digital modified error signal e(k) that forms the input signal of the controller 15. This is tantamount to a conversion in order to free the useful signal from the influence of the feedback controller. Another variant is characterized by the predistortion of the useful signal a(k) by the signal processor 19.

As can be seen in FIG. 1, the secondary path also comprises, in addition to the direct acoustic path that signals coming from the speaker 3 can take to the microphone 3, the digital-to-analog conversion 14, the characteristics of the speaker 2 and of the microphone 3, and the subsequent analog-to-digital conversion 13. The behavior of the secondary path is described mathematically by its transmission function G, namely that of the multiplicative chaining of the transmission functions

- of the digital-to-analog converter (DAC) 14, $G_{DAC}$ upstream from speaker 2,
- of the speaker 2, $G_{rec}$,
- of the distance between speaker and microphone, $G_{acoust}$,
- of the microphone 3, $G_{mic}$, and
- of the analog-to-digital converter (ADC) 13 downstream from microphone 3. Thus we have $$G=G_{DAC}\cdot G_{acoust}\cdot G_{mic}\cdot G_{ADC}.$$

The secondary path is essentially determined by the individual anatomical shape and length of the auditory canal 5 on the one hand and by the seating, i.e. the insertion position and orientation of the earbud 8 in the auditory canal 5 on the other hand. The "nominal" secondary path is therefore a reference path with a standard defined acoustic path between speaker and microphone. An anatomical model of an average human ear canal can be used with an average nominal length and width, or an average volume of the ear canal can be used for this purpose, for example. Alternatively, the secondary path that is present individually in the wearer of the hearing aid can be defined as a nominal secondary path, appropriately measured, and used for further processing. Furthermore, a normal insertion position of the earbud is used for the nominal secondary path, i.e. one in which the earbud is neither too loose and would be apt to fall out of the auditory canal in the event of a movement nor too tight, i.e. inserted too deeply into the auditory canal, which would be unpleasant, or even painful, for the wearer of the hearing aid anyway.

The earbud can be a substantially rotationally symmetrical body with outwardly projecting elastic retaining ribs for example. Alternatively, the earbuds can be formed by a so-called otoplastic that is a molded part fitted to the auditory canal and obtained by molding the inner ear.

The measurement of a secondary path between the speaker and the microphone according to step S1 of the method is inherently known. It can be accomplished by providing a measurement signal through the speaker that is picked up by the microphone, the signal exciting a wide range of frequencies within the auditory canal. For example, the spectrum can include frequencies between 20 Hz and 20 kHz. This spectrum can be traversed with a so-called SWEEP, for example. This means that the signal emits only one frequency at a time, but this is increased or reduced from a start frequency to an end frequency. For example, the measurement signal can be a sine function with a frequency that varies over time. The frequency can be varied linearly or logarithmically, with the high frequencies being passed through more quickly in the case of logarithmic variation. Furthermore, the measurement signal could be a sweep with perfect autocorrelation properties (so-called perfect sweep). Alternatively, the measurement signal can be formed by a noise signal, for example by so-called white or colored noise, by a periodic, random sequence, in particular by a maximum sequence (also known as maximum length sequence (MLS)) or by a sequence with perfect autocorrelation properties (perfect sequence). In this case, all frequencies are excited at the same time.

After the measurement, a transmission function G describing the behavior of the nominal secondary path is determined (step S2). This is described mathematically in the discrete complex z-domain by the ratio of the measured microtone signal $Y_{mic}(z)$ to the measuring signal $X_{mes}(z)$ of the speaker, since the microtone signal $y_{mic}(k)$, through a mathematical convolution of the transmission function g(k) with the measurement signal $X_{mes}(k)$, yields the following in the discrete time domain:

$$y_{mic}(k)=G(k)*x_{mes}(k) \text{ and}$$

$$G(z)-Y_{mic}(z)/x_{mes}(k)$$

The determination of the transmission function G(z) can thus be effected by a spectral division, for example by dividing the Fourier transform of the microtone signal and of the measurement signal by one another. The Fourier transforms can be determined, for example, by the so-called discrete Fourier transformation (DFT) or the so-called fast Fourier transformation (FFT) from the time-discrete values $y_{mic}(k)$ and $X_{mes}(k)$ $$G(z)=FFT(Y_{mic}(z)/x_{mes}(k))$$

Alternatively, the transmission function G of the nominal secondary path can be estimated through so-called adaptive system identification, in which an iterative determination is made of G by starting from an arbitrary first estimated transmission function and repeatedly estimating the estimate G while minimizing the error G-G, until the error is below a predetermined threshold value and the transmission function G has thus been determined with sufficient accuracy, even though it is still an estimate. This method of "adaptive system identification" is also inherently known, so that reference is made to the relevant specialist literature for further information on this method.

While the adaptive system identification is performed in the discrete time domain, the transmission function is determined by spectral division in the frequency domain on the basis of time-discrete variables. It should already be pointed out here that the method according to the invention can be fully carried out either with continuous-time signals x(t), where t represents an arbitrary point in time, or with discrete quantities x(k), where k represents a specific sampling time as a multiple of the sampling interval T. Both constitute a representation of the signal x. In that regard, individual process steps can be carried out in the frequency domain by the Laplace transform X(s) of the time-continuous quantities or by the z-transform X(z) of time-discrete quantities, with the complex variables being $s=\sigma+j\omega$ and $z=e^{\sigma+\omega}$. The determined transmission function of the nominal secondary path can thus be present after the first method step as G(s) or G(z).

After the determination of the transmission function, a first requirement is determined according to the invention in the form of a symmetrical or asymmetrical tolerance band $W_{tol}$ about the transmission function in order to take the uncertainty of the secondary path into account for the controller set-up (step S3). A maximum deviation from the nominal secondary path that the controller must take into account in its regulation is thus established. This can be achieved in various ways.

According to a first variant, a fixed relative limit $W_K$=const can be used to define a tolerance band about the transmission function G. For example, the relative limit can be between ±5% and ±15%, preferably ±10% of G, so that if $W_K$=0.9 then $W_{toi}$=0.9−G, for example, in order to define the lower limit of the tolerance band.

As an alternative to a fixed relative limit, a frequency-dependent relative limit $W_K(f)$ can be defined, for example one in which the distance to G is greater at low and/or high frequencies than at medium frequencies. This takes measurement inaccuracies into account that can occur at low and high frequencies. The lower limit of the tolerance band then results from $W_{toi}=W_K(f)\cdot G$. For better readability and without restricting generality, here only $W_K(f)$ is representative of the time-continuous and time-discrete frequency-dependent limit $W_K(S)$, $W_K(Z)$ (where $\omega=2\pi f$, i.e. $S=j\omega=j2\pi f$ or $z=e^{j\omega}=e^{j2\pi f}$).

According to a third variant, the tolerance band can be determined from a measurement of a number n, preferably a plurality of different secondary paths, for each of which a separate transmission function $G_j$ is then determined as described above. Since the behavior of the secondary path changes from person to person when the insertion position of the earbud 8 is changed relative to the auditory canal 5 and in the case of changes in the auditory canal, a specific secondary path always results for the particular individual case from a multiplicity of possible secondary paths. In order to obtain a robust controller, i.e. one that is adapted for a multitude of different users and situations, it therefore makes sense to "simulate" different situations for the secondary paths and to measure them, so that it becomes clear from the number of different secondary paths what range of dispersion the controller must cover in order to provide the best results for the suppression of the occlusion effect in each case.

In view of the diverse auditory canals 5 that are anatomically possible, it makes sense to consider at least one of the following two extreme cases in the number n of secondary paths, namely an extreme case "free field" and an extreme case "sound channel closure."

In the extreme case "free field," the secondary path through the auditory canal 5 is determined without closure of the sound channel 11. This means that the earbud 8 is not introduced here into the auditory canal 5, resulting in an "acoustic open state." This extreme case virtually simulates an infinitely long auditory canal 5, or one with an especially large volume, although such a case is anatomically impossible. Indeed, the removal of the hearing aid is thus delayed.

In the extreme case of "sound channel closure" the secondary path is measured with a directly closed sound channel 11. This means that the housing of the earbud 8 is closed, so that the sound emitted by the speaker 2 cannot escape from the earbud 8, thus creating a kind of "acoustic short circuit" between speaker and microphone. This extreme case virtually simulates an infinitely short auditory canal 5, or one with an especially small volume, although such a case is also anatomically impossible. This extreme case can occur during insertion of the hearing aid when the sound channel is closed off momentarily.

In view of the various possibilities for seating the earbud 8 in the auditory canal 5, it makes sense given the number n of secondary paths to consider, in addition or as an alternative to the above-described extreme cases, at least one case in which a loose fit of the earbud 8 in the auditory canal 5 is assumed and/or at least one case in which a tight fit of the earbud 8 in the auditory canal 5 is assumed. These cases can be carried out on the above-described anatomical model of a nominal/average human auditory canal, for example. Alternatively, different models with different auditory canals can also be used and the measurement of the secondary paths performed on each of them. As an alternative to the models, real people can also be used. According to another alternative, it is also possible to use an anatomical model of a variable-volume auditory canal 5 in which measurement of the secondary path is performed accordingly with different volumes of the auditory canal 5, for example a changeable basic volume of 2 $cm^2$.

If the hearing aid is to be customized for a particular individual user in any case, it is sufficient if a measurement of the secondary path is carried out on this user with different seatings, particularly a loose, normal, and tight fit of the earbud.

The number of measured secondary paths forms a database of transmission functions Gi where i=1 j n, with n being the number of measured paths. The more different secondary paths are measured, the better it can be recognized how much the secondary path varies or will vary with the hearing aid 1.

The maximum relative or absolute deviation of all measured secondary paths Gj from the nominal secondary path G can then be determined from the data base Gi. For this purpose, a deviation $EG_j$ from the nominal secondary path G is initially determined for each of the measured secondary paths $G_j$, as shown below using the example of the absolute deviation $EG_j$:

$$E_{gj}(j\omega)=G_j(j\omega)-G(j\omega)$$

If the relative deviation Ecj is to be used, the following applies:

$$E_{gj}(j\omega)=(G_j(j\omega)-G(j\omega))/G(j\omega)$$

The frequency-dependent maximum is then determined from all deviations Eci, i.e. the maximum deviation is determined for each frequency from all deviations and defined as the limit WM of the tolerance band to be established:

$$|WM(j\omega|=\max_{Gi}|E_{Gi}(j\omega)|$$

Figure 4:
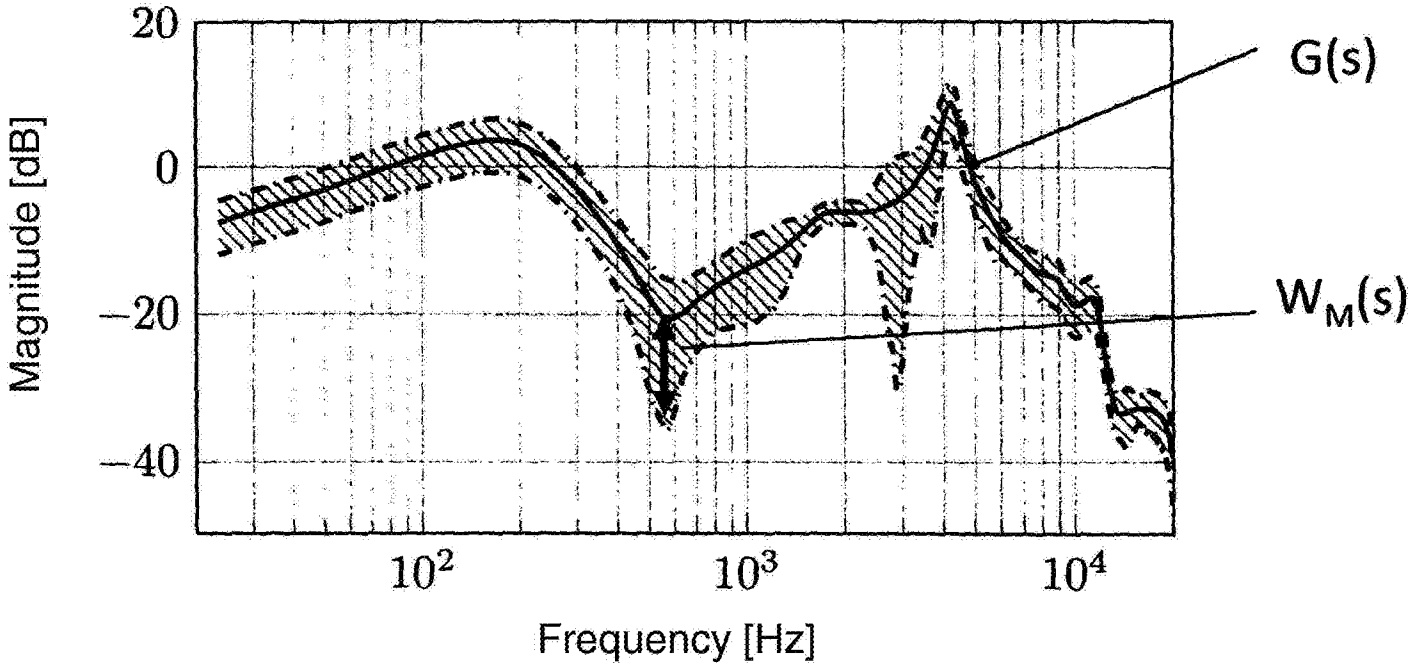
FIGS. 4, 5, and 6 are graphs illustrating the invention.

An exemplary profile of the frequency-dependent maximum deviation or frequency-dependent limit WM(jω) for the nominal secondary path G(s) is shown in FIG. 4. A continuous Laplace domain model for the tolerance band $W_{toi}(s)$ is obtained by modeling the frequency-dependent limit WM(jω). This modeling can be performed, for example, using a minimal-phase filter with the aid of the so-called log-Chebyshev magnitude design as described, for example, in Boyd, S. and Vandenberghe, L., "Convex Optimization," Cambridge University Press, 2004. This yields the first requirement, the tolerance band $W_{toi}(s)$. As an alternative to the variable s, the requirement can be expressed time-discretely with the argument z.

Preferably, the lower limit WM determined according to the third variant can be modified such that the maximum deviation at low and/or high frequencies is increased compared to the middle frequencies, for example between 2% and 10%, preferably around 5%. This takes into account the fact that measurements are always flawed and the signal-to-noise ratio (SNR) is worse at low and high frequencies during the measurement. This can be taken into account in the robustness of the controller by increasing the maximum deviation.

According to a fourth variant, the tolerance band can be determined by an estimation.

After the first requirement is determined in the form of a tolerance band about the transmission function of the secondary path, a second requirement is determined according to the invention in the form of a desired sensitivity function $S_{gew}$ that the hearing aid 1 is to have (step S4). This, too, can be achieved in various ways.

The sensitivity function S describes the behavior of the overall feedback system consisting of controller 15 secondary path G from its input d(t) to its output e(t), the input being formed by the electrical interference signal d(t) and the output being formed by the electrical error signal e(t).

Figure 2:
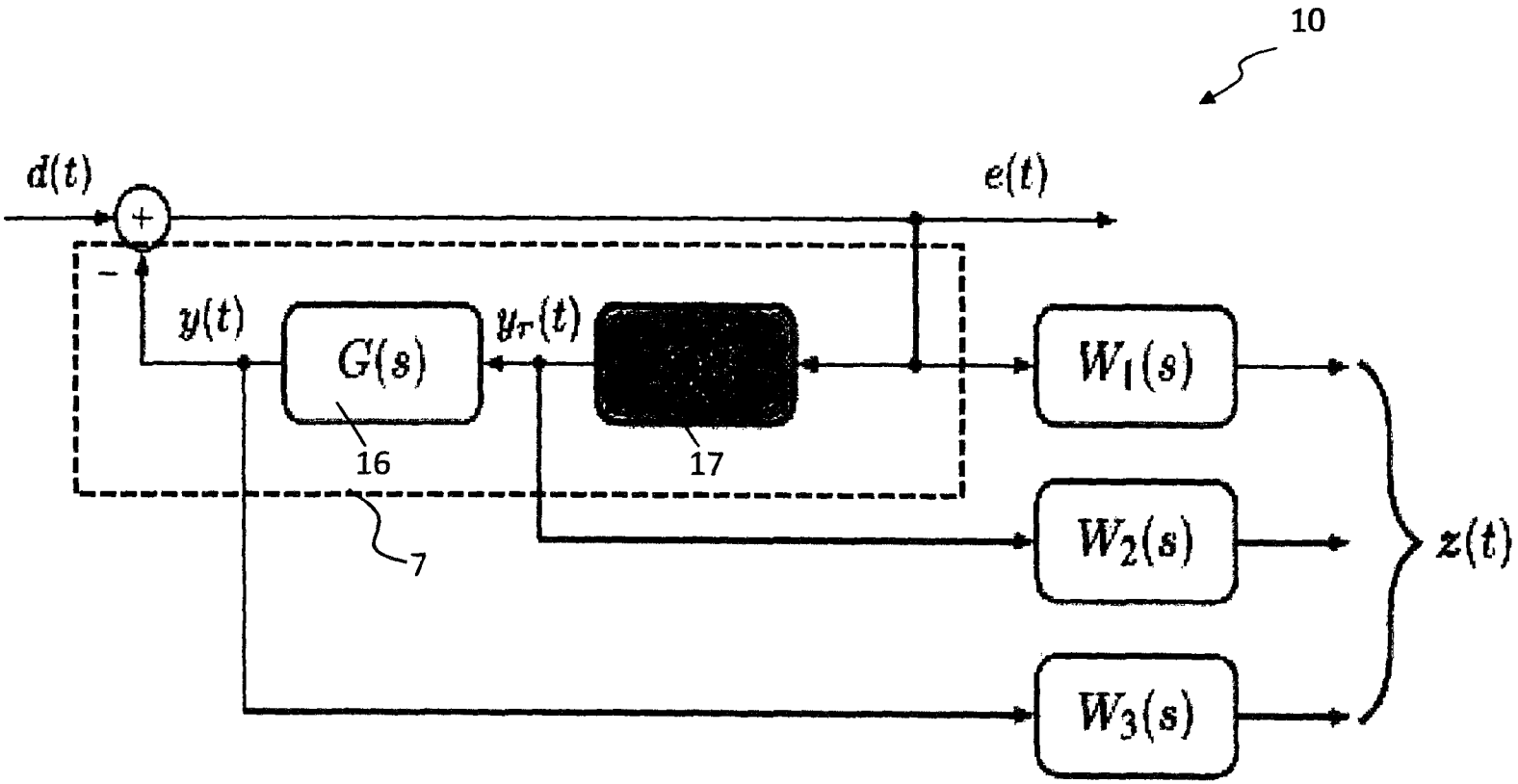
FIG. 2 is a schematic view of a feedback system according to the invention.

This becomes clear from FIG. 2 that shows a time-continuous model view of the overall feedback system in the absence of a useful signal, with the time-continuous interference signal d(t) forming the input of the model and the time-continuous error signal e(t) forming the model output. A time-continuous model 17 of the controller K and a time-continuous model 16 of the secondary path G form the feedback branch here. The model of the overall system according to FIG. 2 is extended by weight functions $W_{1(s)}$, $W_{2(s)}$ $W_{3(s)}$, the meaning and significance of which will be explained below.

The sensitivity function S is obtained mathematically according to the equation $$S=1/(1+G\cdot K)$$

This describes the influence of the interference signal d(t) on the error signal e(t) or the reaction sensitivity of the error signal e(t) to a change in the interference signal d(t), so that it also represents the attenuation of the feedback system. In other words, it is the transmission function from the interference signal d(t) to the error signal e(t).

For the sensitivity function S, a complementary sensitivity function T exists for all frequencies, $$T=(G\cdot K)/(1+G\cdot K)$$

so that the product of complementary sensitivity function T and sensitivity function S is equal to 1. The complementary sensitivity function T describes the influence of the interference d(t) on the compensation signal y(t), i.e. the output of the secondary path and hence also the influence of measurement noise on the compensation signal. It thus reflects the robustness of the system, particularly including against interference due to measurement noise.

Ideally, the sensitivity function S should be small, minimizing interference. At the same time, the complementary sensitivity function T should be small, so that measurement noise has minimal effect. In view of the fact that the sum of sensitivity function S and complementary sensitivity function T is equal to one, however, these two requirements are mutually opposed and cannot be fulfilled simultaneously. This is also referred to as the "fundamental dilemma" of feedback regulation.

The above-described representations of the sensitivity function S and the complementary sensitivity function T can be written as a function of the time-continuous complex variable s or of the time-discrete variable z.

The aim is to form the sensitivity function S so that it corresponds to the inverse of the transmission function $G_o$, of the occlusion effect, since this is to be suppressed according to the invention. Since the occlusion effect is different in the person, the compensation must be ideally adapted to the person.

According to a first design variant, the sensitivity function $S_{gew}$ can be specified manually in the form of a desired sensitivity. For example, the sensitivity function can be configured such that an attenuation of at least 10 dB is present in certain frequency ranges. This can be done in the modeling of $S_{gew}$, for example through combined high and low passes.

According to a second design variant, the sensitivity function $S_{gew}$ can be specified manually from empirical data on the occlusion effect. The empirical data can be obtained through actual measurements on subjects or from data in the literature; for example, see Part II, page 6.2, FIG. 6.1 of M. Ostergaard Hansen, "Occlusion Effects Part I and II," PhD thesis, Technical University of Denmark, Denmark, 1998. If the frequency-response characteristic of the occlusion effect is known from these data, the sensitivity function can be calculated accordingly.

According to a third design variant, the determination of the sensitivity function $S_{gew}$ from the measurement of the objective occlusion effect can be carried out specifically for the person who will later wear the hearing aid. A customized design of the controller is thus achieved.

It should be noted here that, in terms of control engineering, two levels of customization exist for the individual adaptation of the hearing aid to a person. To with, customization of the hearing aid can be achieved through adaptation of the secondary path to the individual auditory canal 5 and/or through adaptation of the sensitivity function S.

The objective occlusion effect is characterized by the objectively measurable difference between the acoustic signal on the eardrum when the ear canal is open and when the ear canal is closed. Thus, it only partially affects the individual subjective perception of one's own voice, since the perception of the voice also includes influences of the middle and inner ear. The objective occlusion effect cannot be measured with a measurement signal that is emitted via an internal or external speaker, because the occlusion effect also includes structure-borne sound components $x'_{BC}(t)$ that cannot be generated via a speaker. In particular, the concrete relationship between airborne sound component $x'_{AC}(t)$ and structure-borne sound component $x'_{BC}(t)$ during dynamic vocal excitation is not easily determined. It must therefore be determined with the person's own voice, meaning that the person's own voice is the measurement signal. Using two microphones calibrated to one another at different measurement positions, with an internal microphone being located inside the ear and an external microphone being located outside the ear, the person pronounces [i:], for example, resulting in a particularly strong occlusion effect, or reads a phonetically balanced text aloud that reflects natural usage, which corresponds to a medium occlusion effect. The resulting microtone signals are recorded. The external microphone thus provides a microtone signal corresponding to the airborne sound component $x'_{AC}(t)$, and the internal microphone provides a microtone signal corresponding to the sound $d'_{occl}(t)$ occurring in the auditory canal 5 when the auditory canal is closed. The frequency-dependent occlusion effect can be determined through spectral division of the Fourier transforms $D'_{occl}(f)$ and $X'_{AC}(f)$ of the respective time signals $d'_{occl}(t)$ and $x'_{AC}(t)$. A transmission function that approximately reflects the occlusion effect can be obtained according to the following equation.

$$G_{OE}(F)=|D'_{occl}(f)|/|X'_{AC}(f)|$$

The fact that this transmission function of the occlusion effect $G_{0E}(f)$ is only an approximate determination of the occlusion effect is evident because the so-called open ear canal characteristic (Real Ear Unoccluded Gain (REUG)) is missing from the calculation but would actually have to be in the denominator of the above equation in order to accurately determine the frequency-dependent occlusion effect. Additional information on the determination of the objective occlusion effect can be found in EP 2 640 095 A1.

Ideally, the desired sensitivity function $S_{gew}$ of the hearing aid is then determined from the transmission function of the occlusion effect $G_{OE}$ as the inverse of the transmission function of the occlusion effect $G_{OE}$:

$$S_{gew}=1/G_{oe}.$$

In view of the necessity of the technical implementability of the controller 15 in a DSP, it is advantageous to reduce the order that the transmission function $G_{OE}$ determined from the measured occlusion effect has, since a DSP has only limited computing power. The implementable order depends here decisively on the sampling rate 1/Ts used in the digital system. In real systems, and at a sampling rate of 1/TS=48000 Hz, the transmission function can have an order of between 10 and 20 in FIR (Finite Impulse Response) and HR (Infinite Impulse Response).

Since the overall order of the controller results from the sum of the orders of the transmission function of the secondary path, the tolerance band, and the sensitivity function, an order of between 30 and 40 can quickly arise here. In order to make implementation possible, it may be necessary to perform a downstream order reduction.

Figure 5:
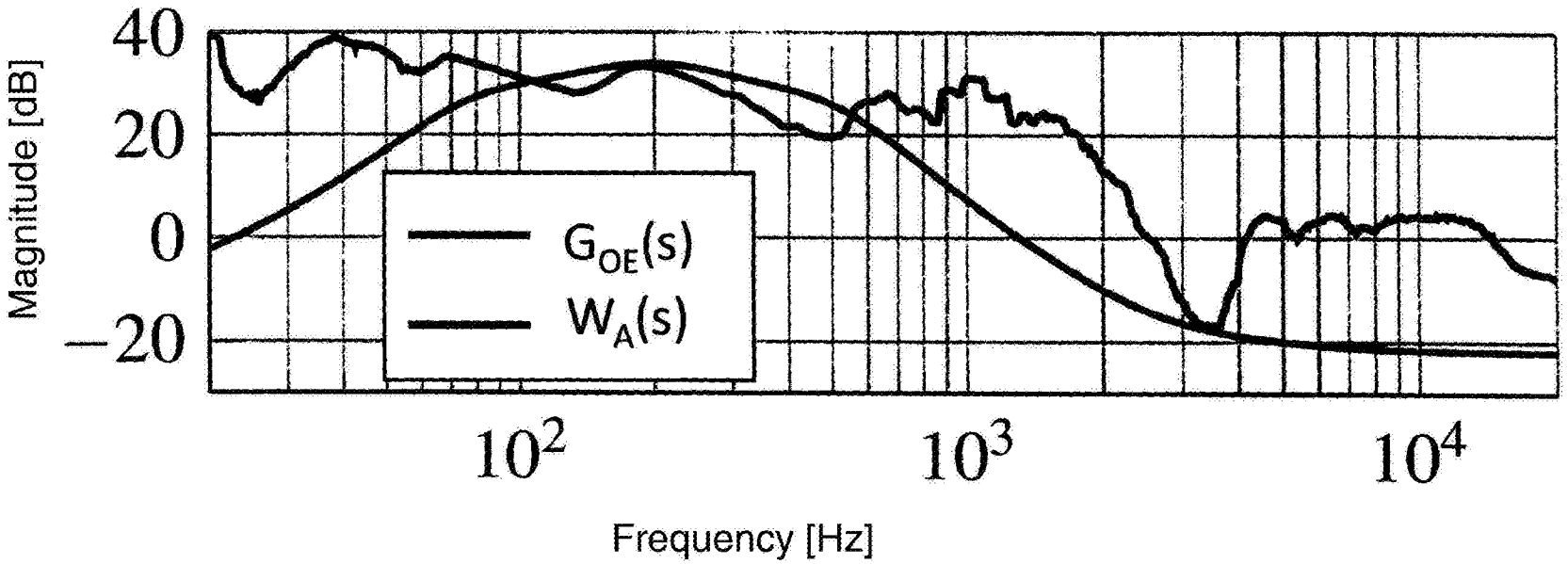

According to a preferred development, the transmission function $G_{OE}$ of the occlusion effect can therefore be approximated by a compensation curve $W_A$ (polynomial) of an order of between 5 and 10, preferably of the order 6, as shown in FIG. 5. While a higher order would improve the compensation, this would also place greater demands on the DSP. The inverse of the compensation curve WA can then be established as the second requirement or desired sensitivity function $S_{gew}$ of the hearing aid.

According to another development, in order to reduce the order even further, the compensation curve can have at least one recursive component, as is known in so-called IIR filters or IIR systems (IIR Infinite Impulse Response). This is characterized in a transmission function in the z-range by coefficients in the denominator, which cause feedback of the filter output.

$$H(z)=b_0+b_1z^{-1}+b_2z^{-2}+\ldots+b_Qz^{-q}/a_0+a_1z^{-1}+a_2z^{-2}+\ldots+a_Qz^{-q}$$

In general, the order in FIR component (numerator) and in the IIR component (denominator) can have different orders Q and R.

The order reduction can be applied not only during the determination of the sensitivity function, but also during or after the determination of the transmission function for the nominal secondary path and during the determination of the tolerance band, since the overall order of the overall feedback system results from the sum of the orders of these three system components. An approximation can thus be made for the nominal measured secondary path as well by a curve with an order that is lesser than the order of the measured nominal secondary path. The same applies to the determined tolerance band.

Once the first requirement and the second requirement have been determined, the digital controller is designed according to the invention by an optimization method with simultaneous consideration of the first and second requirements (step S5).

A model of the system consisting of secondary path and controller can first be set up for this purpose using the example of continuous-time quantities as shown in FIG. 2. In this example, the interference signal d(t) is the input quantity and the error signal e(t) resulting from the difference between the interference signal d(t) and the compensation signal y(t) is the model output quantity. The controller 17 and a downstream model 16 of the secondary path are in the feedback branch, so that the controller 17 receives the error signal e(t) as an input signal and the compensation signal y(t) forms the output signal of the secondary path model 16, which is negatively fed back onto the interference signal.

For the controller design, the two determined requirements must now be incorporated into the model, for example by expanding the system model. According to one design variant, the so-called $H_\infty$-controller design method can be used for this purpose, preferably the special "Mixed Sensitivity H," controller design method as described in S. Skogestad and I. Postlethwaite, "Multivariable feedback control: analysis and design," John Wiley & Sons, 2005. This method uses the extended system model already shown in FIG. 2, particularly at least two of the three weighting functions $W_1$, $W_2$ and $W_3$ shown there. The H, controller design method is the general design method that also enables system models other than shown in FIG. 2 to be employed. The "mixed sensitivity H," controller design method is characterized particularly by the system model shown in FIG. 2. Furthermore, the design can be performed using other methods, such as the $H_2$ controller design method, for example.

The weighting functions $W_1$, $W_2$, and $W_3$ represent transfer functions that, in the example model here, have a single input and a single output. The error signal e(t) is fed to the first weighting function Wi so that it receives the same signal input as the controller 17. The second weighting function $W_2$ receives the output signal yr(t) of the controller 17 as input, and the third weighting function $W_3$ receives the output signal of the secondary path model 16 with the transmission function G as input. The mathematical relationships are indicated here in the Laplace domain, i.e. in the continuous-time spectral range, so that the quantities are written as a function of the variable s. However, it is also possible to use the time-discrete spectral range here, i.e. the Z domain, i.e. to write the quantities as a function of the variable z. These representations can be converted into one another by the Tustin method, in which $$z=e^{sTs}=(1+T_s/2\cdot S)/(1-T_s/2\cdot S$$

The first weighting function $W_1(s)$ reflects the desired overall transmission function of the system and thus represents the performance of the system. The second weighting function $W_2(s)$ reflects the uncertainty in the secondary path in absolute terms, i.e. how much it varies due to different users and/or different location of the earbud in the auditory canal, and thus represents the robustness of the system. The same applies to the third weighting function $W_3(s)$, but in relative form to the nominal secondary path G.

It follows that the weighting functions $W_1(s)$, $W_2(s)$, and $W_3(s)$ can be used to describe the first and second requirements, so that the requirements can be introduced into the model by these weighting functions $W_1(s)$, $W_2(s)$, and $W_3(s)$.

The first weighting function $W_1(s)$ can be determined from the second requirement, and the second or third weighting function $W_2(s)$, $W_3(s)$ from the first requirement. Preferably, the first weighting function $W_1$ (s)=1/$S_{gew}$ (s)=$G_{OE}$(s) and is particularly equated with the compensation curve $W_1(s)$=WA(s). If the deviation $EG_j$ of the measured secondary paths $G_j$ from the nominal secondary path G has been determined in absolute form, then $W_2(s)=W_{tol}(s)$ and $W_3(s)=0$ can be set. If the deviation $EG_j$ of the measured secondary paths $G_j$ from the nominal secondary path G has been determined in relative form, then $W_2(s)=0$ and $W_3(s)=W_{tol}(s)$ can be set.

Each of the weighting functions $W_1(s)$, $W_2(s)$, $W_3(s)$ provides its own output $z_1(t)$, $z_2(t)$, $z_3(t)$ of the model, which are combined into a vector z(t) in FIG. 2:

$$z(t) = \begin{pmatrix} z_1(t) \\ z_2(t) \\ z_3(t) \end{pmatrix}$$

This vector thus forms a combined output of the model. The aim of the $H_\infty$ controller design method is to design the controller K such that the oo norm of the transmission function $T_{zd}(S)$ of the model is minimized from its input d(t) to the combined output z(t). This transmission function $T_{zd}(S)$ is also a vector in the defined model and can be represented as follows in the Laplace domain:

$$T_{zd}(s) = \begin{pmatrix} W_1(s)\cdot S(s) \\ W_2(s)\cdot K(s)\cdot S(s) \\ W_3(s)\cdot K(s)\cdot G(s)\cdot S(s) \end{pmatrix} = \begin{pmatrix} W_1(s)\cdot S(s) \\ W_2(s)\cdot K(s)\cdot S(s) \\ W_3(s)\cdot T(s) \end{pmatrix}$$

It is on this basis that the ∞-norm is now formed and an analysis is performed to determine for which K(s) it becomes minimal:

$$\min_K \|T_{Zd}(s)\|_\infty$$

$$\|T_{zd}(s)\|_\infty = \left\| \begin{pmatrix} W_1(s)\cdot S(s) \\ W_2(s)\cdot K(s)\cdot S(s) \\ W_3(s)\cdot T(s) \end{pmatrix} \right\|_\infty = \gamma$$

This can be done by solving two Riccati equations, as is proposed in J. C. Doyle, K. Glover, P. P. \Khargonekar, and B. A. Francis, "State-space solutions to standard H2 and $H_\infty$ control problems, "IEEE Transactions on Automatic Control," vol. 34, no. 8, pp. 831-847, 1989.

The $H_\infty$ norm is defined as follows as the absolute peak value (supremum) of the maximum singular value Ö($T_{zd}$):

$$\|T_{zd}(s)\|_\infty = \sup_\omega \bar{\sigma}(T_{zd}(j\omega))$$

The supremum, which describes an upper limit of an infinitely extended function, is simplified here to the simple maximum value for finite functions. In the most general case, the maximum singular value ($T_{zd}$) is the root of the largest eigenvalue i of the matrix product from the complex conjugate transmission function and the unchanged transmission function $T_{zd}$ of the extended system model:

$$\lambda_i = eig(T_{zd}^H T_{zd})$$

$$\bar{\sigma}(T_{zd}) = \sqrt{\max_i(\lambda_i)}$$

For a system with an input and an output, this expression can be reduced to the Euclidean vector norm by the transmission function $T_{zd}(S)$; see S. Skogestad and I. Postlethwaite, "Multivariable feedback control: analysis and design," John Wiley & Sons, 2005. The $H_\infty$ norm of the vector-valued transmission function $T_{zd}$ can thus be expressed as $$\|T_{zd}(s)\|_\infty = \max_\omega \sqrt{|W_1 S|^2 + |W_2 R|^2 + |W_3 T|^2}$$

The maximum absolute value of the weighted sensitivities is thus sought over all frequencies ω. If the optimization has worked, it is ensured that $\|W_1(s)\cdot S(s)\|_\infty$ is always less than or equal to the threshold value γ. If the requirements were too stringent, they can be softened within the optimization until a controller can be found. If the optimization produces a controller that contains y=1, all requirements are met. If y<1, a controller could be found that is better than the requirements. For y>1, the requirements had to be reduced.

With the $H_\infty$ controller design method, a controller K can be found that satisfies both set conflicting requirements, i.e. the performance defined with the desired sensitivity function on the one hand and the robustness defined with the tolerance band, and is ideally even better. To with, the identified controller K can result in a sensitivity function S=1/(1+G·K) in the overall system, which is better than the desired sensitivity function $S_{gew}$, meaning that their damping amplitude |S(j)| for all frequencies lies below or at most at the damping amplitude $|S_{gew}(j)|$ of the desired sensitivity function $S_{gew}$:

$$|S(s)| \le |S_{gew}(s)| \frac{1}{|W_1(s)|}$$

Figure 6:
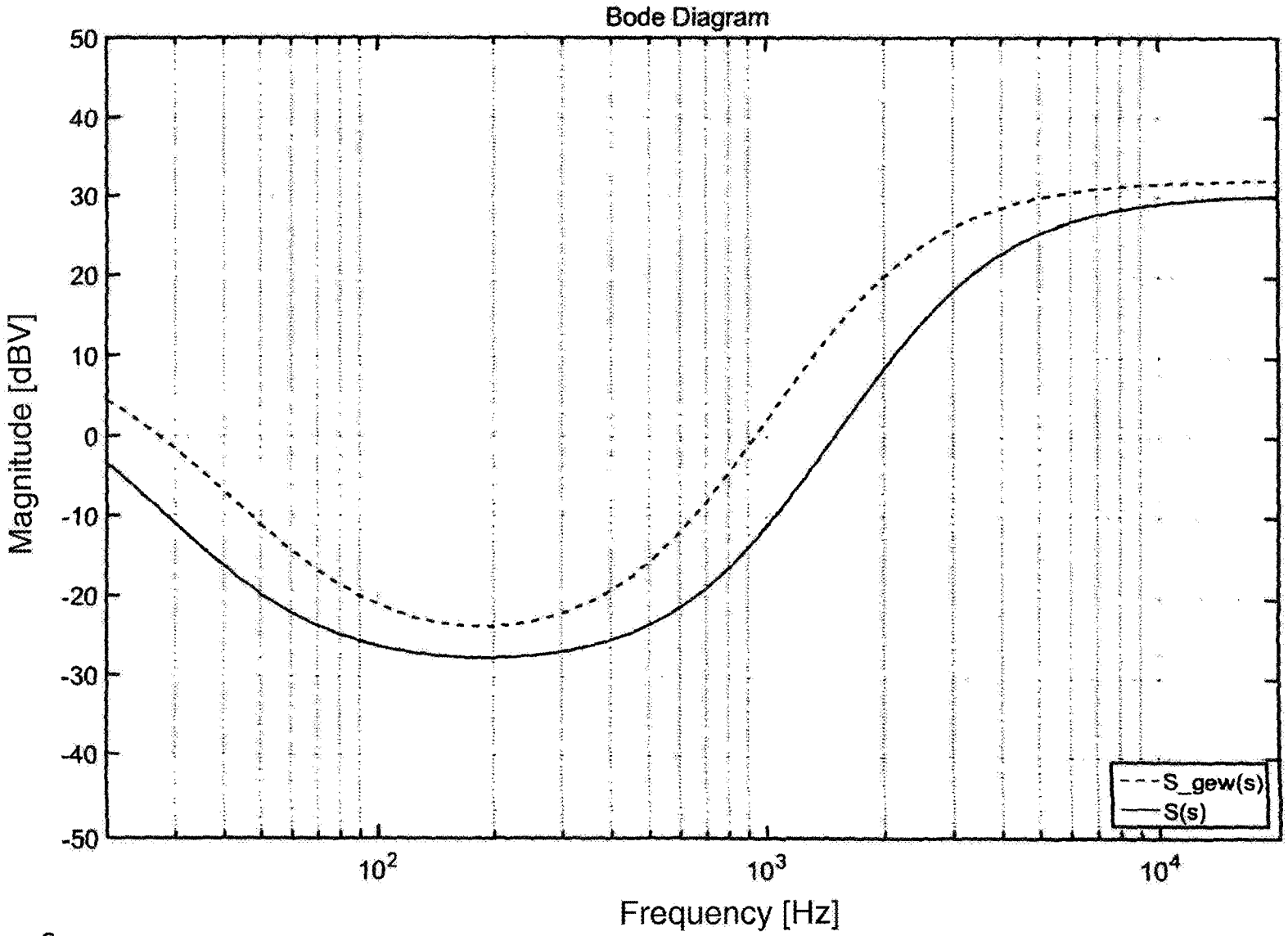

This is shown in the Bode diagram in FIG. 6. It is immediately clear from the above inequality that $|W_1(s)\cdot S(s)| \le 1 = \gamma$ i.e. that with proper optimization, the sensitivity function S(s) of the system with the identified controller K coincides maximally with the desired sensitivity function $S_{gew}$ at individual frequencies. If the threshold γ>1, then at least one of the two requirements must be moderated in order to find a controller that satisfies the requirements. The search for a corresponding controller K using the optimization method is then repeated accordingly.

As the last step S6 of the method according to the invention, the identified controller K is implemented in the control unit 9 as is generally known in the prior art. This implementation can preferably take place as a digital controller, for example in the form of a FIR/IIR filter, or in state space representation on a DSP of the control unit. For this purpose, after the designing of the time-continuous controller K(s), a further discretization is performed, whereby K(z) is obtained. Moreover, in addition or as an alternative to the above-described order reduction for secondary path, tolerance band, or sensitivity function, an order reduction of the designed controller can be carried out with the specified methods.

The invention claimed is:

1. A method of designing a controller for a hearing aid for compensating for an occlusion effect while emitting an acoustic useful signal into an auditory canal of a human ear, where the hearing aid comprises an earbud that can be inserted into the auditory canal, a speaker for emitting a compensation signal into the auditory canal, a microphone for receiving an error signal from the auditory canal, and a control unit for processing a recorded signal to be emitted, the method comprising the following steps:

measuring a nominal secondary path between a speaker and the microphone and determining a transmission function that describes behavior of the nominal secondary path, determining a first requirement as a tolerance band about the transmission function, determining a second requirement as a desired sensitivity function of the hearing aid, designing the controller using an optimization method while simultaneously taking the first and second requirements into consideration, and implementing the controller in the control unit.

2. The method according to claim 1, wherein the tolerance band is determined from a measurement of a plurality of different secondary paths for each of which is determined a respective transmission function is determined, and thereafter a maximum deviation of this transmission function from the transmission function of the nominal secondary path is determined from which the first requirement is established.

3. The method according to claim 2, wherein the plurality of different secondary paths comprises a secondary path in which the earbud is not introduced into the auditory canal and/or comprises a secondary path in which a housing of the earbud is blocked in such a way that the sound emitted by the speaker cannot escape from the earbud.

4. The method according to claim 2, wherein the plurality of different secondary paths comprises a secondary path in which the earbud is loosely inserted into an initial region of the auditory canal and/or comprises a secondary path in which the earbud is firmly inserted into the auditory canal.

5. The method according to claim 4, wherein measurement of the different secondary paths is performed in different auditory canals.

6. The method according to claim 2, wherein the determined maximum deviation forms the first requirement or is first modified such that, for low frequencies and/or high frequencies, an exaggeration of the deviation is present and this exaggerated deviation is used as the first requirement.

7. The method according to claim 1, wherein, in order to determine the second requirement, a transmission function of an objective occlusion effect is determined and its inverse or a function derived from the transmission function is established as a sensitivity function.

8. The method according to claim 7, wherein the derived function is a compensation curve of a reduced order that approximates the transmission function of the objective occlusion effect.

9. The method according to claim 1, wherein the design of the controller is based on a model of the hearing aid formed from the secondary path and the controller, the model having an interference signal to be compensated for as an input quantity and the error signal resulting from the difference between interference signal and compensation signal as output, the controller and a downstream model of the secondary path lying on a feedback path so that the controller receives the error signal as an input signal and the compensation signal forms an output signal of the secondary path model that is negatively fed back onto the interference signal.

10. The method according to claim 1, wherein an $H_\infty$ or $H_2$ controller design method or a combination of these controller design methods is used as an optimization method.

* * * * *